US007189682B2

(12) United States Patent
Gapinski

(10) Patent No.: US 7,189,682 B2
(45) Date of Patent: Mar. 13, 2007

(54) ALL-WEATHER TRACTOR HYDRAULIC FLUID USING A MIXTURE OF VISCOSITY MODIFIER TYPES TO MEET SHEAR-STABLE MULTIGRADE VISCOSITY REQUIREMENTS

(75) Inventor: Richard E. Gapinski, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 494 days.

(21) Appl. No.: 10/473,200

(22) PCT Filed: Apr. 4, 2002

(86) PCT No.: PCT/US02/10906

§ 371 (c)(1),
(2), (4) Date: Sep. 25, 2003

(87) PCT Pub. No.: WO02/086036

PCT Pub. Date: Oct. 31, 2002

(65) Prior Publication Data

US 2004/0110647 A1 Jun. 10, 2004

Related U.S. Application Data

(60) Provisional application No. 60/285,377, filed on Apr. 20, 2001.

(51) Int. Cl.

| | |
|---|---|
| ***C07C 69/34*** | (2006.01) |
| ***C08F 8/14*** | (2006.01) |
| ***C10M 145/14*** | (2006.01) |
| ***C10M 145/15*** | (2006.01) |
| ***C10M 169/04*** | (2006.01) |

(52) U.S. Cl. ..... 508/468; 508/110; 508/465; 508/469; 508/472; 508/473

(58) Field of Classification Search ..... 508/468, 508/110, 465, 469, 472, 473
See application file for complete search history.

(56) References Cited

U.S. PATENT DOCUMENTS

| | | | | |
|---|---|---|---|---|
| 3,702,300 | A | 11/1972 | Coleman | 252/51.5 |
| 5,520,832 | A | 5/1996 | Alexander | 252/56 R |
| 5,635,459 | A | 6/1997 | Stoffa et al. | 508/186 |
| 5,646,099 | A | 7/1997 | Watts et al. | 508/232 |
| 5,703,023 | A | 12/1997 | Srinivasan | 508/468 |
| 5,707,943 | A | 1/1998 | Covitch | 508/466 |
| 5,843,873 | A | 12/1998 | Butke et al. | 508/185 |
| 5,888,946 | A | 3/1999 | Zakarian et al. | 508/469 |
| 6,124,249 | A | 9/2000 | Seebauer et al. | 508/469 |
| 6,133,210 | A | 10/2000 | Tipton | 508/469 |

FOREIGN PATENT DOCUMENTS

| | | | |
|---|---|---|---|
| EP | 204587 A2 | * | 12/1986 |
| WO | WO 97/04049 | * | 2/1997 |
| WO | WO02/083825 | | 10/2002 |

* cited by examiner

*Primary Examiner*—Patrick D. Niland
(74) *Attorney, Agent, or Firm*—David M. Shold; Michael F. Esposito

(57) ABSTRACT

A composition of the following components: an oil of lubricating viscosity; a polymethacrylate viscosity modifier; an ester of a maleic acid/styrene copolymer; and optionally, an additive package that imparts to the fluid the capacity to meet bench and dynamometer tests specified by an equipment manufacturer, is suitable for use as a functional fluid such as a tractor hydraulic fluid, under a wide variety of climatic conditions.

12 Claims, No Drawings

ALL-WEATHER TRACTOR HYDRAULIC FLUID USING A MIXTURE OF VISCOSITY MODIFIER TYPES TO MEET SHEAR-STABLE MULTIGRADE VISCOSITY REQUIREMENTS

BACKGROUND OF THE INVENTION

This application claims priority from U.S. Provisional Application 60/285,377, filed Apr. 20, 2001.

The present invention relates to a functional fluid, such as a tractor hydraulic fluid, which exhibits shear stable viscosity characteristics and has a wide temperature range of operation.

Requirements for physical characteristics of functional fluids, including lubricating oils, are becoming more stringent. Equipment manufacturers want lower viscosities at low temperatures (i.e. −40° C.) while maintaining high temperature (100° C.) thickening. They also want the oil to be more shear stable, that is, to maintain its viscosity after shearing. The present invention relates to the use of mixtures of viscosity modifier types that produce an improvement in these physical properties of a lubricating oil over the use of any of the viscosity modifiers used singly.

Previous methods used to solve this problem have involved judicious selection of base oils and viscosity modifiers. Often, though, low temperature fluidity must be achieved by using very thin base oils, and the high temperature viscosity requirements are then met with the use of viscosity modifiers. The tightening of the shear stability requirement has severely limited the choice of viscosity modifiers because many are not capable of meeting the shear requirements.

U.S. Pat. No. 6,133,210, Tipton, discloses concentrates for preparing lubricating oil compositions such as automatic transmission fluids. The viscosity index improver can be at least one of a polyacrylate ester copolymer, optionally containing nitrogen-containing groups; and an esterified carboxy-containing interpolymer, where one of the monomers is a vinyl aromatic monomer and the other monomer is an alpha, beta-unsaturated acylating agent. The polyacrylate ester can have a $\overline{M}_n$ of 20,000 to about 100,000. The esterified carboxy-containing interpolymer can have an RSV of 0.05 to 0.35.

U.S. Pat. No. 6,124,249, Seebauer et al., discloses viscosity improvers for lubricating oil compositions, being a copolymer with units of methacrylic acid esters containing 7–12 and 13–19 carbon atoms in the ester group; and a comonomer that can be dimethylaminopropylmethacrylamide. Auxiliary viscosity improvers can also be included in the lubricating composition, including esterified styrene-maleic anhydride copolymers (col. 16). The molecular weight ($\overline{M}_w$) of the acrylic copolymer is listed as 20,000 to 120,000

U.S. Pat. No. 5,646,099, Watts et al., discloses an automatic transmission fluid of improved viscometric properties, containing (among other components) 0.05 to 2.0 weight percent of a flow improver selected from the group consisting of $C_8$ to $C_{18}$ dialkylfumarate vinyl acetate copolymers, styrene-maleic anhydride copolymers, polymethacrylates, polyacrylates, and their mixtures.

The present invention, therefore, solves the problem of providing low temperature fluidity, high temperature viscosity and shear stability in a fluid by using two types of viscosity modifiers: a polymethacrylate ester and an ester of a maleic anhydride/styrene copolymer. Such fluids are useful in a variety of climatic conditions.

The fluids of the present invention are advantageously used as tractor hydraulic fluids and can also be used as a variety of other functional fluids, including manual transmission fluids, automatic transmission fluids (including fluids for continuously variable transmissions and traction drives) and other hydraulic fluids. They can also be used in other lubricating applications such as gear oils and engine oils.

SUMMARY OF THE INVENTION

The present invention provides a composition suitable for use as a functional fluid in a variety of climatic conditions, comprising the following components:

(a) an oil of lubricating viscosity;

(b) 2 to 30 percent by weight of a viscosity modifier having a weight average molecular weight of 10,000 to 60,000; and (c) 1 to 6 percent by weight of a second viscosity modifier, having a weight average molecular weight greater than that of component (b) and being 50,000 to 200,000;

wherein one of (a) and (b) is a polyacrylate or polymethacrylate and the other of (a) and (b) is a polymer comprising vinyl aromatic units and esterified carboxyl-containing units.

The invention further comprises a concentrate comprising:

(a) 10 to 70 percent by weight of an oil of lubricating viscosity;

(b) 20 to 80 percent by weight of a viscosity modifier having a weight average molecular weight of 10,000 to 60,000; and (c) 10 to 60 percent by weight of a second viscosity modifier having a weight average molecular weight greater than that of component (b) and being 50,000 to 200,000;

wherein one of (a) and (b) is a polyacrylate or polymethacrylate and the other of (a) and (b) is a polymer comprising vinyl aromatic units and esterified carboxyl-containing units.

The invention further provides a method for lubricating a tractor or off-road vehicle, comprising supplying thereto the composition described above.

DETAILED DESCRIPTION OF THE INVENTION

Various preferred features and embodiments will be described below by way of non-limiting illustration.

Component (a) is base oil of lubricating viscosity. Specific examples of lubricating oils include natural oils and synthetic oils.

Natural oils include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic/naphthenic types that may be further refined by hydrocracking, hydrofinishing, or dewaxing processes. Oils of lubricating viscosity derived from coal or shale are also useful. Useful natural base oils may be those designated by the American Petroleum Institute (API) as Group I, II, or III oils. Upon occasion, highly refined or hydrocracked natural oils have been referred to as "synthetic" oils. More commonly, however, synthetic lubricating oils are understood to include hydrocarbon oils and halo-substituted hydrocarbon oils such as polymerized and interpolymerized olefins (e.g., polybutylenes, poly(1-decenes)), alkyl-benzenes (e.g., dodecylbenzenes); polyphenyls; alkylated diphenyl ethers, and alkylated diphenyl sulfides. Polyalpha olefin oils are also referred to as API Group IV oils. Other suitable oils include those prepared by Fischer-Tropsch syntheses.

Alkylene oxide polymers and interpolymers and derivatives thereof where the terminal hydroxyl groups have been modified such as by esterification or etherification constitute another class of known synthetic lubricating oils. Other synthetic lubricating oils include esters of dicarboxylic acids (e.g., phthalic acid, succinic acid, alkyl succinic acids) with a variety of alcohols (e.g., butyl alcohol, hexyl alcohol, ethylene glycol). Silicon-based oils such as siloxane oils and silicate oils comprise another useful class of synthetic lubricants. Other synthetic lubricating oils include liquid esters of phosphorus-containing acids.

Another class of oils is known as traction oils, which are typically synthetic fluids containing a large fraction of highly branched or cycloaliphatic structures, i.e., cyclohexyl rings. Traction oils or traction fluids are described in detail, for example, in U.S. Pat. Nos. 3,411,369 and 4,704,490.

Unrefined, refined, and re-refined oils can be used. Unrefined oils are those obtained directly from a natural or synthetic source without further purification treatment. Refined oils are similar to the unrefined oils except they have been further treated in one or more purification steps to improve one or more properties. Re-refined oils are obtained by processes similar to those used to obtain refined oils applied to refined oils which have been already used in service.

A more complete description of oils of lubricating viscosity can be found in PCT publication WO00/70001.

The amount of component (a) in the compositions of the present invention is generally 70 to 93% by weight. Preferably the amount of component (a) is 72–88%. More preferably the amount of component (a) is 75–87%.

Components (b) and (c) are two viscosity modifiers, each having defined compositions and molecular weights. The components (b) and (c) are selected from polyacrylate or polymethacrylate and polymers comprising vinyl aromatic units and esterified carboxyl-containing units. If component (b) is a polyacrylate or polymethacrylate, then component (c) will be the polymer comprising vinyl aromatic units and esterified carboxyl-containing units. If component (b) is the polymer comprising vinyl aromatic units and esterified carboxyl-containing units, then component (b) will be the polyacrylate or polymethacrylate. Component (b) is the lower molecular weight polymer, and component (c) is the higher molecular weight polymer. That is to say, one or the other of the viscosity modifiers will have a higher molecular weight than the other, within the limits set forth below. Either of the two viscosity modifiers may be selected as the higher molecular weight polymer, although it is preferred the polyacrylate or polymethacrylate polymer be the higher molecular weight species, that is, the species described as component (b). In the following description, the higher molecular weight component (b) is described as the higher molecular weight species, although within the broad scope of the invention, these roles could be reversed. Similarly, the amounts set forth below for components (b) and (c) will apply regardless of which of the viscosity modifiers is designated as (b) or (c).

Component (b), then, is preferably a polyacrylate, preferably polymethacrylate, dispersant viscosity modifier. This is typically a copolymer that preferably comprises units derived from both (i) methacrylic acid esters containing 8 to 24 (preferably 10 to 18) carbon atoms in the alcohol moiety of the ester group and (ii) methacrylic acid esters containing 1 to 12 or 6 to 12 (preferably 8 to 10) carbon atoms in the alcohol moiety of the ester group, where the number of carbon atoms in (i) is greater than the number of carbon atoms in (ii). The ester groups in (ii) typically have 2-($C_{1-4}$ alkyl)-substituents, that is, branching, on the alcohol moiety. However, polymers having only a single type of ester group may also be suitable. Optionally the polymer also comprises (iii) at least one monomer selected from the group consisting of: methacrylic acid esters containing 1 to 10 (preferably 2 to 8) carbon atoms in the alcohol moiety of the ester group and which are different from methacrylic acid esters (i) and (ii); vinyl aromatic compounds; and nitrogen-containing vinyl monomers. Examples of the latter are methacrylamide and N-alkyl-substituted methacrylamides, as well as others described below. Preferably no more than 60% by weight of the esters should contain fewer than 12 carbon atoms in the alcohol-derived moiety of the ester group. The esters in group (i) can contain 12 or 13 to 16 carbon atoms in the alcohol portion of the ester group, and those in group (ii) can contain 8 or 9 to 12 carbon atoms in the alcohol portion of the ester group. A preferred example of ester (ii) is 2-ethylhexyl methacrylate.

Alcohols that are useful for preparing ester (i) typically contain 8 to 24 carbon atoms, preferably 12 to 15 carbon atoms. Mixtures of alcohols are commercially available and are frequently preferred. The alcohols used to prepare ester (i) can be linear or branched. In one embodiment, 2 to 65% of the alcohols are branched, and frequently 5 to 60% are branched. Examples of alcohols useful to prepare ester (i) include n-octanol, n-decanol, n- and branched-$C_{12}$, $C_{15}$, $C_{16}$, and $C_{22}$ alcohols, mixtures of alcohols, e.g., $C_{12-15}$ alcohols available under the tradenames Dobanol™ 25, Neodol™ 25, Lial™ 125, and Alchem™ 125, that have varying degrees of branching, for example, 5% to 50% branching, or even more, and Alfol™ 1214, which is substantially linear.

Alcohols that are useful for preparing ester (ii) typically contain 6 to 11 carbon atoms, preferably 8 to 11, and most preferably 8 carbon atoms. These alcohols normally have a 2-($C_{1-4}$ alkyl) substituent, namely, methyl, ethyl, or any isomer of propyl or butyl. Examples of alcohols useful for preparing ester (ii) include 2-methylheptanol, 2-methyldecanol, 2-ethylpentanol, 2-ethylhexanol, 2-ethyl nonanol, 2-propyl heptanol, and 2-butyl heptanol.

The mole ratio of esters (i) to esters (ii) within the polymer is typically within the range of 95:5 to 35:65.

Useful nitrogen containing monomers include those selected from the group consisting of vinyl-substituted nitrogen heterocyclic monomers, for example vinyl pyridine and N-vinyl-substituted nitrogen heterocyclic monomers such as N-vinyl imidazole, N-vinyl pyrrolidinone, and N-vinyl caprolactam; dialkylaminoalkyl acrylate and methacrylate monomers, for example N,N-dialkylaminoalkyl acrylates such as dimethylaminoethyl methacrylate; dialkylaminoalkyl acrylamide and methacrylamide monomers, for example di-lower alkylaminoalkylacrylamide, especially where each alkyl or aminoalkyl group contains 1 to 8 carbon atoms, especially 1 to 3 carbon atoms, such as N,N-di lower alkyl, especially, dimethylaminopropylacrylamide, N-tertiary alkyl acrylamides and corresponding methacrylamides, for example tertiary butyl acrylamide; and vinyl-substituted amines.

Specific examples of this type of component include those prepared from mixtures of methacrylate monomers having different alkyl groups that are either straight chain or branched chain groups containing from 1 to 18 carbon atoms, and preferably copolymerized with a small amount of nitrogen-containing monomer such as vinyl pyridine, N-vinyl pyrrolidone, N,N'-dimethylaminoethyl methacrylate, or N,N'-dimethylaminopropyl methacrylamide.

Otherwise expressed, component (b) can be a copolymer comprising units derived from (i) 5% to 75% by weight of alkyl acrylate ester monomers containing 1 to 11 carbon atoms in the alkyl group; (ii) 25% to 95% by weight of alkyl acrylate ester monomers containing 12 to 24 carbon atoms in the alkyl group; and (iii) 0.1% to 20% by weight of at least one nitrogen-containing monomer selected from the group consisting of vinyl-substituted nitrogen heterocyclic monomers, N,N-dialkylaminoalkyl acrylate monomers, N,N-dialkylaminoalkyl acrylamide monomers and tertiary-alkyl acrylamides, provided that the total equals 100%. In a representative polymer, 60 to 80% by weight (typically about 68%) of the monomers are $C_{12}$ to $C_{15}$ alkyl methacrylate, 20 to 40% (typically about 30%) 2-ethylhexylmethacrylate, and 1-5% (typically about 2%) of the monomers are dimethylaminopropylmethacrylamide.

The weight average molecular weight of the polymer of (b) (of which-ever species) as determined by gel permeation chromatography (using a polystyrene standard) is typically 10,000 to 60,000, preferably 25,000 to 50,000, or 30,000 to 40,000, or 32,000 to 36,000 or 33,000 to 34,000. Approximately corresponding number average molecular weights are, broadly, 10,000 to 300,000, more often 15,000 to 30,000, typically 17,000 to 19,000.

Such polymers are described in greater detail in U.S. Pat. Nos. 5,969,068 and 6,124,249

The amount of component (b) in the compositions of the present invention is generally 2–30% or 2–18% by weight. Preferably the amount of component (b) is 4–12% or 5–10%.

Component (c) is a second viscosity modifier as described above, preferably a copolymer of a vinyl aromatic monomer and an esterified carboxy-containing monomer. Suitable vinyl aromatic monomers include styrene and the substituted styrenes, although other vinyl aromatic monomers can also be used. The substituted styrenes include styrenes that have halo-, amino-, alkoxy-, carboxy-, hydroxy-, sulfonyl-, hydrocarbyl- wherein the hydrocarbyl group has from 1 to about 12 carbon atoms and other substitutes. Exemplary of the hydrocarbyl-substituted styrenes are alpha-methylstyrene, para-tert-butylstyrene, alpha-ethylstyrene, and para-lower alkoxy styrene. Mixtures of two or more vinyl aromatic monomers can be used. Styrene is preferred.

The carboxy-containing monomer is polymerized with vinyl aromatic monomer to form a carboxy-containing interpolymer. Since the carboxy-containing monomer is incorporated into the polymer backbone, the carboxy groups extend from the polymer backbone, e.g., the carboxy groups are directly attached to the polymer backbone.

The copolymer may comprise ester monomers with a mixture of relatively longer chain alcohol derived moieties (8 or more carbon atoms, for example, mixed alcohols of 8 to 18 carbon atoms) and relatively shorter chain alcohol derived moieties (1 to 7 carbon atoms, for example, n-butanol). A typical molar ratio of longer chain to shorter chain units is (70–95):(5–30).

An optional element in the esterified copolymer is an amino group derived from amino compounds, and particularly those having an average of from 1 to about 1.1 primary or secondary amino groups. In one embodiment the amino compound is a polyamino compound having at least one mono-functional amino group. An example of such amino compounds is aminopropylmorpholine. Such amino groups can be present to neutralize residual acid functionality in the polymer and can serve to enhance the dispersability of such esters in lubricant compositions and additives for lubricant compositions. In one embodiment, the molar ratio of the carboxy groups of said interpolymer that are esterified to the carboxy groups neutralized through the conversion thereof to amino-containing groups is generally 85:15 to 99:1. A preferred ratio is about 95:5. The linkage containing the carbonyl-amino group may be salt, imide, amide, or amidine functionality.

Typical polymers of the type of component (c) are esterified maleic anhydride/styrene copolymers. The monomers are present in approximately a one-to-one ratio in the copolymer. Specific examples of this type of component include those in which the alcohol reactants are chosen from those having from 4 to 18 carbon atoms, and the residual acidity after esterification is neutralized with an amine. The foregoing polymers, mixtures thereof, and details of their preparation are described in greater detail in U.S. Pat. No. 5,707,943 and in references cited therein.

The weight average molecular weight of the viscosity modifier of (c) (of whatever its type) is typically 50,000 to 200,000, preferably 100,000 to 130,000 (polystyrene standard). Approximately corresponding number average molecular weights can be 10,000 to 50,000, preferably 20,000 to 25,000. The amount of component (c) in the compositions of the present invention is generally 1–6% by weight. Preferably the amount of component (c) is 1–5%. More preferably the amount of component (c) is 1.5–4%. Alternative embodiments include those with an upper limit of component (c) of 3 or 2.5 or 2.4 percent by weight. Certain commercially available forms of the polymer of (c) are provided with approximately 50% polymer and 50% diluent oil, if such materials are used, the amounts would be adjusted accordingly (e.g., to a broad range of 2–12%, and so on).

The total amount of components (b) and (c) in the composition will broadly be determined by the amounts set forth above individually for (b) and (c). In certain embodiments, the total of these components will be 5–15%, or 8–12%, or 9–11% by weight.

Component (d) is a mixture of components, some or all of which are typically present in a fully formulated lubricant of the present type. However, such a mixture is not considered to be required in any particular detail in order for the formulation to exhibit the improved viscosity properties of the present invention. Component (d) is a fully formulated additive package suitable to meet an original equipment manufacturer's requirements for a functional fluid of the type under consideration, such as a tractor hydraulic fluid. The details of such a package can be varied considerably in a manner well known to those skilled in the art of formulation of lubricating fluids. Such variations will be determined, in part, by the requirements of the specific equipment to receive the lubricant composition. Examples of additives and additive packages that have been used in tractor hydraulic fluids are disclosed in U.S. Pat. Nos. 5,635,459 and 5,843,873.

Specific examples of this type of component typically include among other materials, metal-containing detergents, such as 1–2% (e.g. 1.41%) of a calcium-overbased sulfonate detergent; antioxidants or anti-wear agents, such as 1–2% (e.g., 1.69%) of a zinc dialkyldithiophosphate; 0.5 to 2% (e.g. 1.03%) of friction modifiers;, and 0.1 to 2 % (e.g., 0.25%) of a nitrogen-containing dispersant such as succinimide dispersants. Other conventional components may also be present, if desired.

The composition described above is typically prepared by adding components b, c and d to component a, the oil, and mixing at an appropriate temperature, such as approximately 60° C., until homogeneous.

The above components can be in the form of a fully formulated lubricant or in the form of a concentrate (that is, an additive package) within a smaller amount of lubricating oil. If they are present in a concentrate, their concentrations will generally be approximately an order of magnitude or more greater than in a final lubricant composition. For example, the amount of the oil of lubricating viscosity (a) can be 10–70 percent by weight, or 20–60 percent, or 30–50 percent; the amount of the first viscosity modifier (b) can be 20 to 80 percent by weight or 30–70 percent; and the amount of the second viscosity modifier (c) can be 10 to 60 percent by weight, or 20–50 percent.

The first step in carrying out the method of the present invention is to blend components a-c or a-d as described above. Thereafter the mixture typically is supplied to the fluid reservoir of the equipment to be lubricated, and thence to the moving parts of the equipment itself.

EXAMPLES

In the examples presented below, the amounts are expressed as percent by weight. The polymethacrylate viscosity modifier is a mixed alkyl methacrylate copolymer containing a small amount of dimethylaminoproylmethacrylamide, as described above, except as indicated. The esterified maleic anhydride/styrene copolymer is a material, as described above, which is esterified with a mixture of alcohols and further reacted with amine.

TABLE

| Item | Ex.: | 1 (ref.) | 2 (ref.) | 3 | 4 | 5 | 6 |
|---|---|---|---|---|---|---|---|
| Component, % | | | | | | | |
| Base Oil | | 91.7 | 87.9 | 89.2 | 90.7 | 91.8 | 91.8 |
| Polymethacrylate viscosity modifier ($\overline{M}_w$ as indicated) | | | 7.6<br>40,000 | 4.59<br>40,000 | 6.96[a]<br>20,000 | 6.17<br>33,000 | 6.17<br>33,000 |
| Esterified maleic anhydride/styrene copolymer ($\overline{M}_w$ 170,000) | | 3.84 | | 1.68 | 2.3 | 1.8 | 1.8 |
| Additive package | | 4.49 | 4.49 | 4.49 | 0 | 0.2[b] | 0.2[b] |
| Test Method* | Preferred Limit | | | | | | |
| D445 @ 40° C. | <45 | 40.9 | 44.4 | 43.8 | 44.7 | 44.4 | 44.5 |
| D445 @ 100° C. | >8.8 | 8.8 | 8.7 | 8.9 | 9.0 | 9.1 | 9.1 |
| D2983 @ −20° C. | <3.00 | 1.53 | n.d. | 1.61 | 1.80 | 1.72 | 1.68 |
| D2983 @ −40° C. | <30.0 | 21.5 | 86.0 | 25.5 | 27.5 | 26.0 | 25.5 |
| D2603A (% shear after 30 minutes) | <20 | 30.8 | 3.1 | 15.6 | 20 | 15.6 | 16.3 |

| Item / Ex: | 7 | 8 | 9 | 10 | 11 | 12 | 13 |
|---|---|---|---|---|---|---|---|
| Component | | | | | | | |
| Base Oil | 92.0 | 92.2 | 92.4 | 92.3 | 92.4 | 91.9 | 92.1 |
| Polymethacrylate viscosity modifier ($\overline{M}_w$ as indicated) | 6.1<br>33,000 | 5.95<br>33,000 | 5.65<br>33,000 | 5.50<br>33,000 | 5.28<br>33,000 | 6.32<br>33,000 | 6.03<br>33,000 |
| Esterified maleic anhydride/styrene copolymer ($\overline{M}_w$ 170,000) | 1.9 | 1.9 | 2.0 | 2.2 | 2.3 | 1.8 | 1.9 |
| Additive package | 0 | 0 | 0 | 0 | 0 | 0 | 0 |
| Test Method* | | | | | | | |
| D445 @ 40° C. | 44.2 | 44.1 | 43.6 | 44.2 | 44.9 | 44.0 | 44.3 |
| D445 @ 100° C. | 9.1 | 9.0 | 9.0 | 9.1 | 9.3 | 9.0 | 9.1 |
| D2983 @ −20° C. | 1.70 | 1.63 | 1.58 | 1.61 | 1.65 | 1.73 | 1.63 |
| D2983 @ −40° C. | 25.5 | 26.5 | 24.5 | 26.5 | 25.5 | 26.0 | 26.5 |
| D2603A (% shear after 30 minutes) | 16.3 | 16.7 | 18.2 | 18.4 | 19.1 | 15.8 | 16.8 |

| Item / Ex: | 14 | 15 | 16 | 17 | 18 (ref.) | 19 (ref.) |
|---|---|---|---|---|---|---|
| Component | | | | | | |
| Base Oil | 92.0 | 92.0 | 92.5 | 92.4 | 93.4 | 93.5 |
| Polymethacrylate viscosity modifier ($\overline{M}_w$ as indicated) | 6.18<br>33,000 | 6.18<br>33,000 | 5.13<br>33,000 | 4.91[a]<br>20,000 | 6.54<br>61,000 | 6.30<br>61,000 |
| Esterified maleic anhydride/styrene copolymer ($\overline{M}_w$ 170,000) | 1.8 | 1.8 | 2.4 | 2.7 | 0.1 | 0.24 |
| Additive package | 0 | 0 | 0 | 0 | 0 | 0 |

TABLE-continued

| Test Method* | | | | | | |
|---|---|---|---|---|---|---|
| D445 @ 40° C. | 44.0 | 43.8 | 45.0 | n.d. | n.d. | n.d. |
| D445 @ 100° C. | 9.0 | 9.0 | 9.3 | 9.0 | 9.0 | 8.9 |
| D2983 @ −20° C. | 1.64 | 1.62 | 1.72 | 1.64 | n.d. | n.d. |
| D2983 @ −40° C. | 27.0 | 26.5 | 25.5 | 24.0 | 57.0 | 35.0 |
| D2603A (% shear after 30 minutes) | 16.2 | 16.2 | 21.1 | 22.5 | 11.4 | 11.9 |

ASTM - D445 determines the kinematic viscosity of a fluid at the specified temperature. Results are presented in units of $mm^2/s$ (cSt).
ASTM - D2983 measures the low-shear-rate viscosity of a lubricant at specified temperatures from −5 to −40° C. Results are presented in Pa-s ($10^{-3}$ centipoise)
ASTM - D2603A measures permanent shear loss in a lubricant after irradiating the lubricant in a sonic oscillator, and for this application is run for 30 minutes.
n.d. not determined
[a]without dimethylaminoproylmethacrylamide monomer.
[b]pour point depressant amount of a polymethacrylate or maleic anhydride/styrene copolymer.

The results show that the use of mixtures of two types of viscosity modifiers enable a single oil to meet the kinematic viscosity requirements at 40° C. and 100° C., D2983 requirements at −20° C. and −40° C. as well as the 30 minute D2603A requirement. These requirements could not be met by use of either viscosity modifier alone. Of particular note is the improvement obtained in the D445 test at 100° C. and the D2603A test.

In examples 16 and 17 it is noted that the shear loss is somewhat higher than in other examples. It is believed that these values could be reduced to within the preferred range of less than 20 by reducing the total amount of viscosity modifier or the amount of the esterified styrene/maleic anhydride copolymer somewhat.

As used herein, the term "hydrocarbyl substituent" or "hydrocarbyl group" is used in its ordinary sense, which is well known to those skilled in the art. Specifically, it refers to a group having a carbon atom directly attached to the remainder of the molecule and having predominantly hydrocarbon character. Examples of hydrocarbyl groups include:

hydrocarbon substitutes, that is, aliphatic (e.g., alkyl or alkenyl), alicyclic (e.g., cycloalkyl, cycloalkenyl) substitutes, and aromatic-, aliphatic-, and alicyclic-substituted aromatic substitutes, as well as cyclic substitutes wherein the ring is completed through another portion of the molecule (e.g., two substitutes together form a ring);

substituted hydrocarbon substitutes, that is, substitutes containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

hetero substitutes, that is, substitutes which, while having a predominantly hydrocarbon character, in the context of this invention, contain other than carbon in a ring or chain otherwise composed of carbon atoms. Heteroatoms include sulfur, oxygen, nitrogen, and encompass substitutes as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substitutes in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil that may be customarily present in the commercial material, unless otherwise indicated. It is to be understood that the upper and lower amount, range, and ratio limits set forth herein may be independently combined within an individual component and among different components. As used herein, the expression "consisting essentially of" permits the inclusion of substances that do not materially affect the basic and novel characteristics of the composition under consideration.

What is claimed is:

1. A composition suitable for use as a functional fluid in a variety of climatic conditions, comprising the following components:

(a) an oil of lubricating viscosity;

(b) about 4 to about 12 percent by weight of a viscosity modifier having a weight average molecular weight of about 10,000 to about 60,000; and (c) about 1 to about 5 percent by weight of a second viscosity modifier, having a weight average molecular weight greater than that of component (b) and being about 100,000 to about 200,000;

wherein (b) is a polyacrylate or polymethacrylate and (c) is a polymer comprising vinyl aromatic units and esterified carboxyl-containing units, and wherein the total amount of component (b) and component (c) is 5 to 15 percent by weight.

2. The composition of claim 1, wherein the polyacrylate or polymethacrylate viscosity modifier is a polymethacrylate which comprises units derived from both (i) methacrylic acid esters containing 8 to 24 carbon atoms in the alcohol moiety of the ester group and (ii) methacrylic acid esters containing 6 to 12 carbon atoms in the alcohol moiety of the ester group, where the number of carbon atoms in (i) is greater than the number of carbon atoms in (ii).

3. The composition of claim 2 wherein the polyacrylate or polymethacrylate viscosity modifier also comprises (iii) at least one monomer selected from the group consisting of: methacrylic acid esters containing 1 to 10 carbon atoms in the alcohol moiety of the ester group and that are different from methacrylic acid esters (i) and (ii); vinyl aromatic compounds; and nitrogen-containing vinyl monomers.

4. The composition of claim 1 wherein the copolymer comprising vinyl aromatic units and esterified carboxy-containing units is an esterified styrene/maleic acid copolymer xvhercin the ester moieties comprise a mixture of alcohol derived moieties having 8 or more carbon atoms and alcohol derived moieties having 1 to 7 carbon atoms.

5. The composition of claim 4 wherein the esterified styrene/maleic acid copolymer further comprises an amino group derived from an amino compound.

6. The composition of claim 1 further comprising:

(d) an additive package that imparts to the fluid the capacity to meet bench and dynamometer tests.

7. The composition of claim 6 wherein said additive package comrises at least one component selected from the group consisting of metal-containing detergents, antioxidants, and-wear agents, friction modifiers, and nitrogen-containing dispersants.

8. A concentrate comprising:

(a) about 10 to about 70 percent by weight of an oil of lubricating viscosity;

(b) about 20 to about 80 percent by weight of a viscosity modifier having a weight average molecular weight of about 10,000 to about 60,000; and (c) about 10 to about 60 percent by weight of a second viscosity modifier having a weight average molecular weight greater than that of component (b) and being about 50,000 to about 200,000;

wherein (b) is a polyacrylate or polymethacrylate and (c) is a polymer comprising vinyl aromatic units and esterified carboxyl-containing units.

9. A method for lubricating a tractor or off-road vehicle, comprising supplying thereto the composition of claim 1.

10. The composition of claim 1 wherein polyacrylate or polymethacrylate viscosity modifier (b) is a polymethacrylate; and wherein the copolymer comprising vinyl aromatic units and esterified carboxy-containing units (c) is an esterifled styrene/maleic acid copolymer.

11. The composition of claim 1 wherein the polyacryl ate or polymethacrylate viscosity modifier (b) is a polyacrylate or polymethacrylate which comprises units derived from both (i) acrylic or metbacrylic acid esters containing 8 to 24 carbon atoms in the alcohol moiety of the ester group and (ii) acrylic or methacrylic acid esters containing 6 to 12 carbon atoms in the alcohol moiety of the ester group, where the number of carbon atoms in (i) is greater than the number of carbon atoms in (ii); and wherein in the copolymer comprising vinyl aromatic units and esterifled carboxy-containing units (c), the ester moieties comprises a mixture of alcohol derived moieties having 8 or more carbon atoms and alcohol derived moieties having 1 to 7 carbon atoms.

12. The composition of claim 10 wherein the polyacrylate or polymethacrylate viscosity modifier (b) is a polymethacrylate; and wherein the copolymer comprising vinyl aromatic units and esterifled carboxy-containing units (c) is an esterifled styrene/maleic acid copolymer.

* * * * *